United States Patent [19]

Day

[11] Patent Number: 4,823,821

[45] Date of Patent: Apr. 25, 1989

[54] AUTOMATIC SINGLE PUSH BUTTON TYPE UMBRELLA

[76] Inventor: San-Tong Day, 1 Chung Yang North Road, Ching Shui, Taichung Hsien, Taiwan

[21] Appl. No.: 47,488

[22] Filed: May 11, 1987

[51] Int. Cl.[4] ..... A45B 25/16

[52] U.S. Cl. ..... 135/24; 135/22

[58] Field of Search ..... 135/22, 24, 20 M, 20 R

[56] References Cited

U.S. PATENT DOCUMENTS

| | | | |
|---|---|---|---|
| 3,658,077 | 4/1972 | Sato | 135/24 |
| 3,746,025 | 7/1973 | Murata | 135/22 |
| 3,856,030 | 12/1974 | Sato | 135/22 |
| 4,421,133 | 12/1983 | Huang | 135/24 |
| 4,534,374 | 8/1985 | Day | 135/24 |
| 4,548,222 | 10/1985 | Day | 135/24 |
| 4,685,482 | 8/1987 | Yung | 135/20 M |

*Primary Examiner*—David A. Scherbel
*Assistant Examiner*—Caroline D. Dennison
*Attorney, Agent, or Firm*—Burns, Doane, Swecker & Mathis

[57] ABSTRACT

An umbrella is expanded by spring action and collapsed by spring action. Both spring actions are initiated by a single push button which is manually manipulated in the same manner for initiating both spring actions.

5 Claims, 4 Drawing Sheets

AUTOMATIC SINGLE PUSH BUTTON TYPE UMBRELLA

BACKGROUND OF THE INVENTION

The present invention relates to a single-push-button-controlled automatic umbrella and, more particularly, to an automatic umbrella wherein, the opening and collapsing is controllable by a single push button.

In the past, several types of automatic umbrellas have been disclosed, to cite for example, U.S. Pat. No. 3,856,030 to Sato. In that prior art, the umbrella employs two push buttons for opening and closing respectively. Such an umbrella is not only complicated in construction but is also difficult and troublesome in assembling, and hence is of high cost. To obviate these shortcomings the present inventor discloses in U.S. Pat. Nos. 4,534,374 and 4,548,222 a different and improved type of automatic umbrella. In operation, the umbrella may be opened by depressing the single push button in the first stage. When the umbrella which has been opened is next to be closed, the push button now in its second stage is first slid downwardly and then depressed. Although the single push button opening and closing mechanism thus constructed simplifies the operation and construction in an umbrella, nevertheless, it is still a way from perfection in view of its requirement that in operation the user's thumb has to perform two different actions. In addition, a larger space has to be provided in the grip for pulling up and down of the push button. Also, the resiliency of the spring pawl formed integrally with the locking head may be adversely affected after being used for some time as a result of restriction by its shape and material.

SUMMARY OF THE INVENTION

The present invention overcomes the problems associated with the conventional automatic umbrella by providing a single push button type automatic umbrella having push button system being more simplified, more precise and more easily operated.

An object of the invention is to provide a single-push-button, automatic umbrella in which the single push button is capable of controlling the opening and closing of the umbrella in two-stage sequence by directly pressing against a locking member in a uni-directional manner.

Another object of the invention is to provide a single-push-button controllable, automatic umbrella wherein push button means is mounted directly adjacent the locking member thereby simplifying the construction and reducing the cost of production, and occupying relatively less space in the grip and thus adding tidiness to the external shape of the grip.

A further object of the invention is to provide a single-push-button controllable, automatic umbrella, whose locking member is mounted in the shaft by a shaft pin and a spring means for simplifying the construction thereof, and through the spring push button means of this single member to ensure delivery of an effective energy of recovery resiliency to the locking member.

Other aspects and advantages of the present invention will become apparent from the following description of the preferred embodiment, taken in conjunction with the accompanying drawings in which.

DETAILED DESCRIPTION OF THE PREFERRED EMBODIMENT

Figure 1:
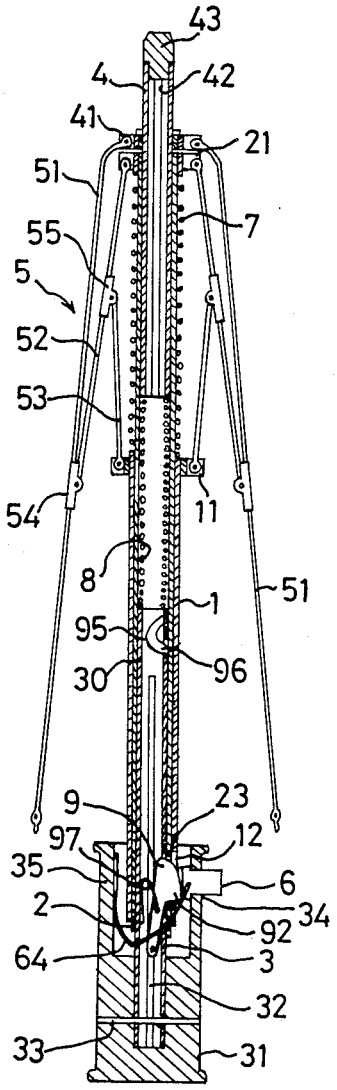
FIG. 1 illustrates an umbrella of the present invention in partly sectional elevation in the closed and folded state.

The automatic umbrella according to the present invention comprises, as shown in FIG. 1, an outer tubular shaft 1 having a lower ring 11 fixed to the shaft upper portion, an intermediate tubular shaft 2 slidably telescoped within the outer tubular shaft 1 and an intermediate ring 21 fixed to the upper portion of the intermediate shaft 2. A lower inner shaft 3 is slidably telescoped within the lower end portion of intermediate tubular shaft 2, and a grip 31 is mounted to the lower end thereof. An upper inner shaft 4 is slidably telescoped within the upper end portion of intermediate tubular shaft 2 and is provided with an upper ring 41 fixed at the middle portion thereof. A rib assembly 5 comprises a plurality of ribs pivotably connected at inner ends to the rings 11, 21 and 41, as will be explained. An operating push button 6 is mounted between the upper portion of the grip 31 and the lower inner shaft. A first spring 7 is provided for closing the umbrella. That spring 7 is mounted around the upper end portion of intermediate tubular shaft 2 and acts against the intermediate and lower rings 21 and 11. A second spring means 8, adapted for opening the umbrella is provided in the intermediate tubular shaft 2 and acts against the upper and lower inner shafts, 4 and 3.

Figure 3:
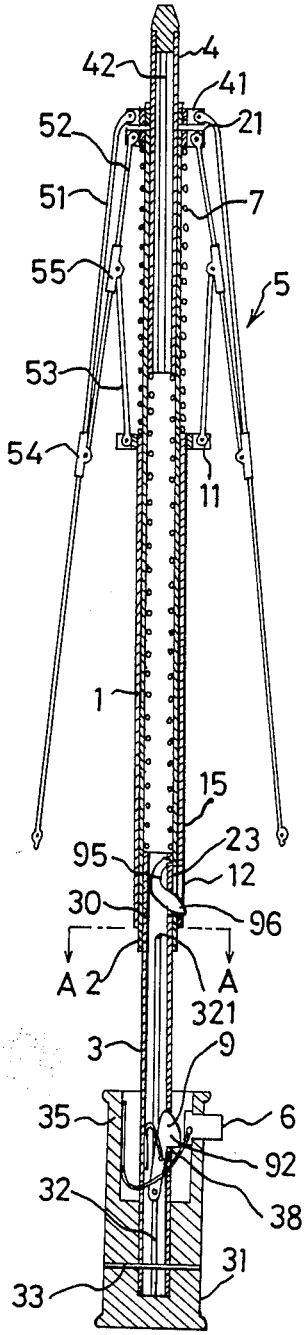
FIG. 3 depicts the umbrella in partly sectional elevation in a collapsed state from the position as shown in FIG. 2.
Figure 4A:
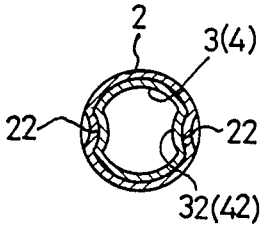
FIG. 4(A) is a sectional view of the portion of the umbrella taken along the line A—A in FIG. 3.
Figure 4B:
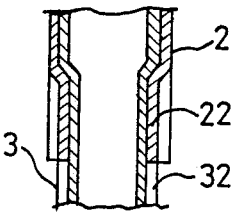
FIG. 4(B) is a longitudinal sectional view of portion of the members shown in FIG. 4(A)
Figure 5:
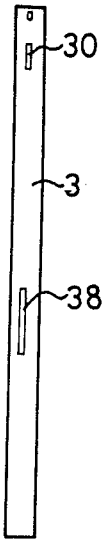
FIG. 5 illustrates a portion of the lower inner shaft wherein axial slot and openings are shown.

In a lower end of the abovementioned outer tubular shaft 1 there is formed a rectangular locking opening 12 to allow the engagement therein of a locking head to be described hereinafter. The intermediate tubular shaft 2 which is slidably inserted in the outer tubular shaft 1 is longer in length than the latter and is provided at the upper end thereof with the intermediate ring 21 fixed thereto. The inner sides of upper and the lower end portions of the shaft 2 are further formed with at least one, preferably two, according to the present embodiment, convex portions 22, 22 as shown in FIGS. 4(A) and 4(B). In operation, said two convex portions 22, 22 prevent the upper and the lower inner shafts 3, 4 from rotating inside the intermediate shaft 2 and also act as a guide-projection when the two inner shafts 3, 4 are sliding up and down therein. Furthermore, an opening 23 is defined on one side wall of the intermediate shaft 2 at the lower end thereof and located between the two convex portions 22, 22 to allow an enlarged head 92 of a locking pawl 9, which will be described hereinafter, to be engaged therein. Both the lower and the upper inner shafts, 3, and 4, are defined with at least one, but preferably, two symmetrically arranged guide-grooves 32, 42 as illustrated in FIGS. 4(A) and 4(B). The upper portion of the lower inner shaft 3 is slidably inserted in the lower portion of intermediate shaft 2 and prevents the intermediate shaft 2 from escaping out upwardly from the lower inner shaft 3. This guide-groove 32 of lower inner shaft 3 is formed at the upper end with a check shoulder 321 (that is, a guide-groove 32 is not defined therein). The lower end of upper inner shaft 4 is slidably inserted in the upper end portion of intermediate tubular shaft 2, while the convex portions 22, 22 formed respectively at the upper and the lower end portions of intermediate shaft 2 are engaged respectively in the guide-grooves 42, 32 of the upper and the lower inner shafts 4, 3 in order to impede rotation inside the intermediate shaft 2 by the two inner shafts 4, 3. The grip 31 is fixedly mounted to the lower end portion of lower inner shaft 3 by a fixed pin 33 provided therewith, and on upper end of said grip 31 is formed a sleeve member 35 having an oblong opening 34 being defined on one side face thereof. This opening 34 of the sleeve member receives therein the operating push button 6 having its outer end protruding out of the opening. The push button 6 is resiliently and slidably retained in the opening 34 by a return spring 64 which at one end is connected to the button and at an oppose end abuts against. The push button includes an inner flange 65 which at the lower portion includes a bevel face 67 for use in release. The locking pawl 9 is pivotably mounted in the inside of lower inner shaft 3 by a shaft pin 93. The enlarged head 92 formed at the upper end of said locking pawl projects out from the front end outer portion of an elongated slot-shaped opening 38 formed on the inner shaft 3. Engaging one side of said upper end is a return spring 97 which is also engaging the inner circumference of inner shaft 3 in order to enable the locking pawl 9 to be returned and sprung out of the opening 38 and openings 23 and 12. At the upper end of lower inner shaft 3 there is provided a small spring pawl 95 functioning like a leaf-spring, the locking head 96 of which projects out from an opening 30 being defined in said inner shaft 3 and is capable of moving into the openings 23 and 12 in the inner shaft 2 and outer tubular shaft 1 and being engaged therein as shown in FIG. 3. In addition, an upper ring 41 is mounted generally the middle portion of the upper inner shaft 4, the upper end of which is screwed with a cap 43.

Figure 6:
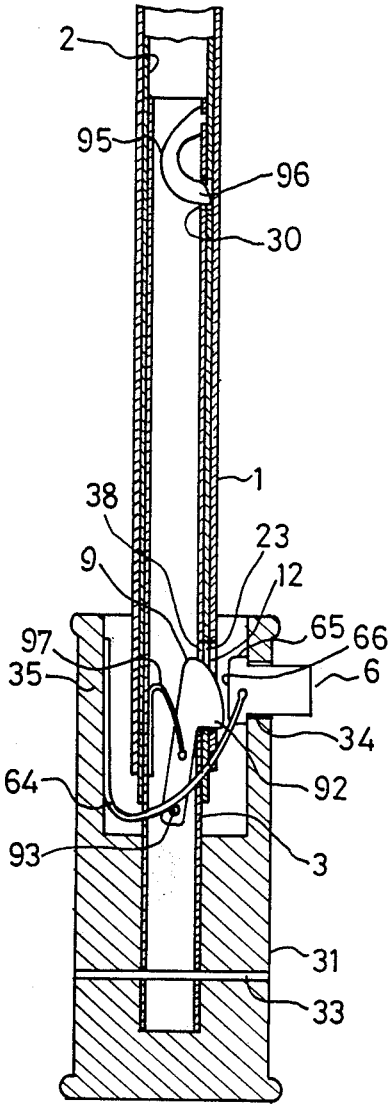
FIG. 6 is an enlarged sectional view of a detail of operation of the push button mechanism shown in FIG. 1.
Figure 7:
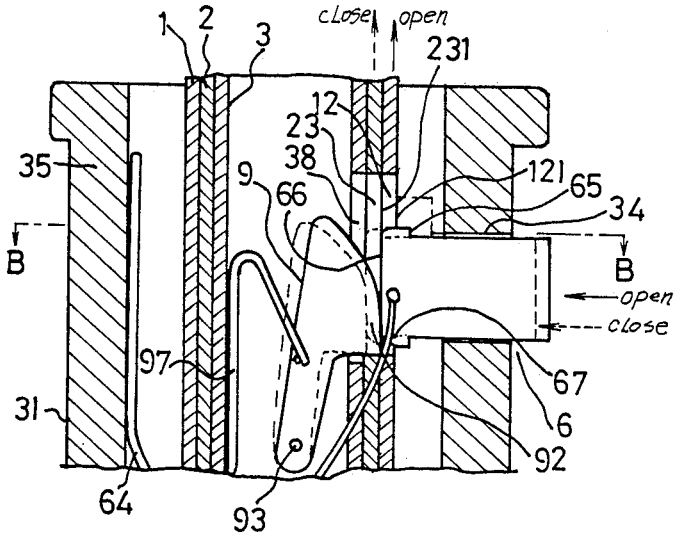
FIG. 7 is an enlarged sectional view showing the operating condition in the push button mechanism.
Figure 8:
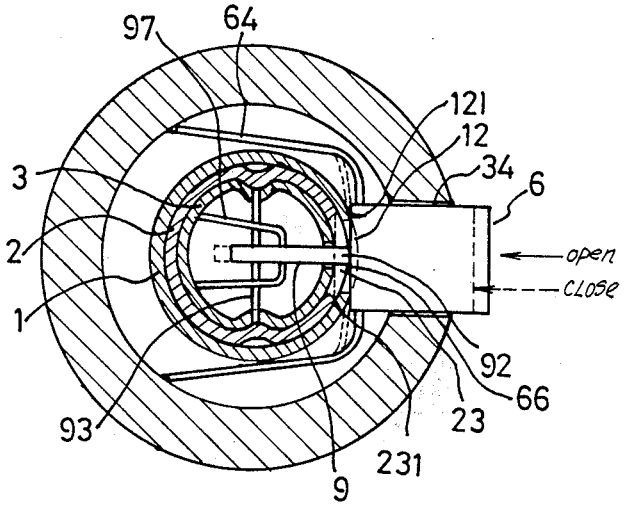
FIG. 8 is an illustration depicting the operating condition in the push button mechanism taken along the line B—B of FIG. 7.

As illustrated in FIGS. 6 through 8, inside the oblong opening 34 of grip 31, an inner face 66 of push button 6 is located adjacent the locking head 92 and between the upper and lower edges of the two openings, 12 and 13. During operation of the push button in opening of the umbrella, when the locking head 92 has been pressed in by the push button 6, the inner face of said push button 6, which just lies across the edge tops 121 at the two sides of the opening 12, will upon reaching the outer circumference of intermediate shaft 2 press against the locking head 92 and force the latter to be disengaged from the opening 12, and can not be depressed any more. Again, in operation of the push button for closing the umbrella, when the locking head 92 is being pressed in by the push button 6, this push button 6, being located now at the place of the opening 23 in the intermediate shaft, will upon reaching the outer circumference of inner shaft 3 by its bottom face 66 force the locking head 92 to be completely disengaged from the opening 23.

The rib assembly 5 includes usually 8 to 10 dome ribs 51, a same number of stretcher ribs 52 and a same number of supporting ribs 53. One end of each dome rib 51 is pivotably mounted to the upper ring 41 while the other end thereof remains free and the middle portion thereof is, on the other hand, provided with a pivot member 54 adapted to connect pivotably with one end of the stretcher rib 52. The other end of the stretcher rib is pivotably mounted to the intermediate ring 21. The middle portion of the stretcher rib 52 is provided with a pivot member 55 adapted to connect pivotably with one end of the supporting rib 53 while the other end of the rib 53 is pivotably mounted to the lower ring 11. When the umbrella is in a closed position, the coil spring 7 disposed between the intermediate ring 21 and the lower ring 11 is in its freely extended condition as shown in FIG. 1. Under the same condition when the umbrella is in the closed position, the coil spring 8 disposed in the intermediate shaft 2 between the upper and the lower inner shafts 4, 3 is, on the other hand, in its compressed condition and tends to urge the upper and the lower inner shafts 4, 3 upward and downward respectively. However, since the intermediate shaft 2 and outer shaft 1 are all locked by the enlarged head 92 of locking pawl 9 at this time, the coil spring 7, 8 are thus unable to pull apart the intermediate shaft 2 and the outer shaft 1, and the upper inner shaft 4 and lower inner shaft 3.

Figure 2:
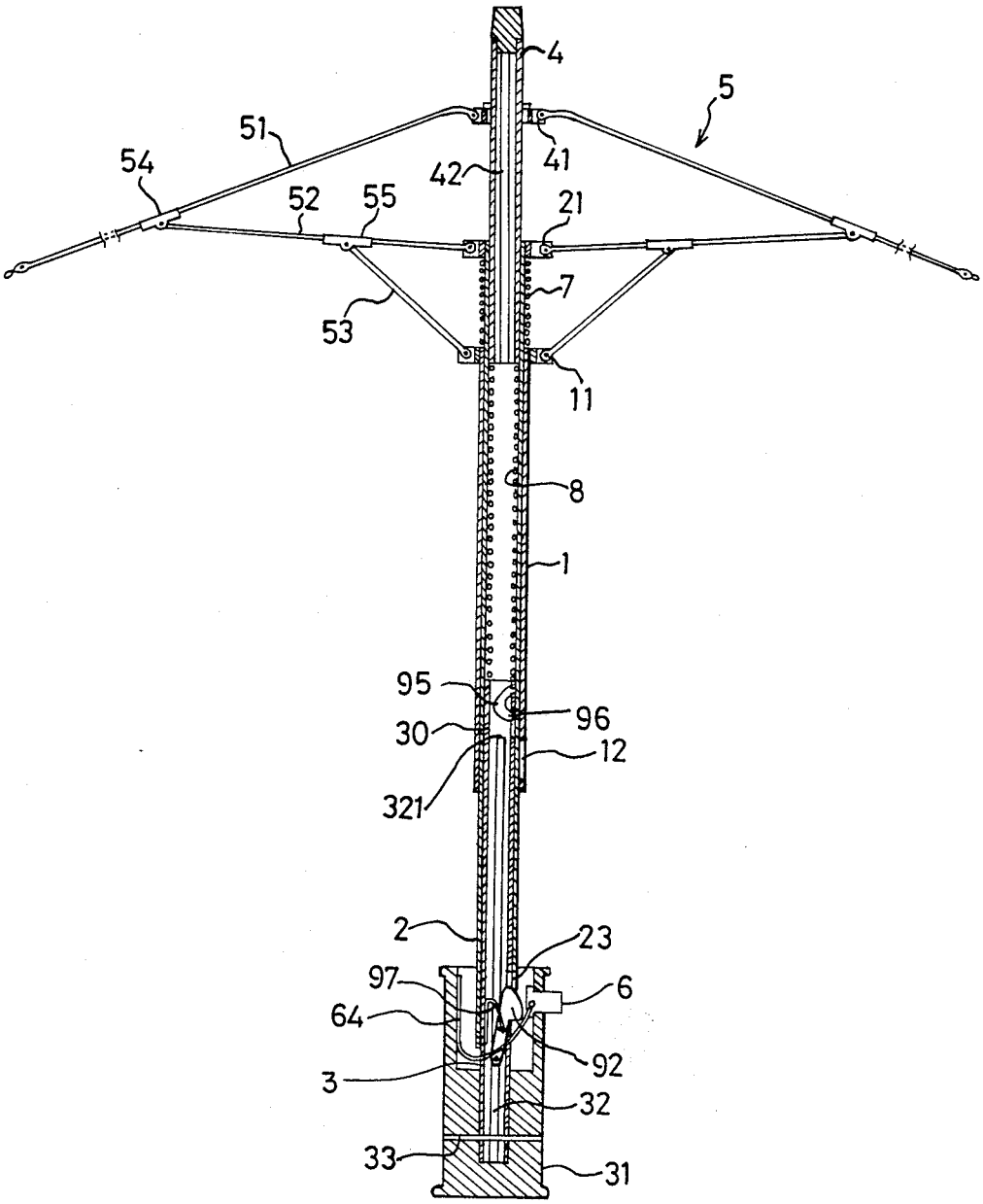
FIG. 2 shows the umbrella of FIG. 1 in partly sectional elevation in the fully extended position.

In operation, when the automatic umbrella of the invention is in the fully closed position as shown in FIG. 1, the rib assembly 5 is completely collapsed, the coil spring 7 is in the released and fully extended condition and the coil spring 8 is being compressed thereby accumulating elastic energy. In this position, both the immediate and the outer shafts 2, 1 and the lower inner shaft 3 are locked in engagement by the enlarged head 92 thereby maintaining the umbrella in the closed condition. The inner face 66 of the push button is spaced from the enlarged head 92. In the process of opening the umbrella from its presently closed position, the push button 6 is first depressed in against the resilient force of the springs, 64 and 97 so that the abutment surface 66 moves to a first stop position against vertical edges 121 of the opening 12. The abutment surface 66 thus presses the enlarged head 92 inwardly come down. In this way, the enlarged head 92 is released from the opening 12 of outer shaft 1 and falls into the opening 23 of intermediate shaft 2 thereby releasing the outer shaft 1 and thus permits said outer shaft 1 to be slid upwardly. Thereafter, when push button 6 is released, said push button will immediately return to its original position by the return spring 64 and also by the bevel-faced portion 67 at the bottom thereof. Owing to the upward extension force of the coil spring 8, the outer shaft 1 being released from the engaging position now will force the upper inner shaft 4 to move upward with respect to the intermediate shaft 2 and consequently, the upper ring 41 will also be moving upward along with the upper inner shaft 4. Although the dome ribs 51 which are pivotably mounted at one end to the ring 41 will now tend to move upward along with the latter, such movement is prevented because of the mid portions of ribs 51 being pivotably connected to the stretcher ribs 52. In that regard, inner ends of the ribs 52 are pivotably mounted to the immediate ring 21 and said intermediate ring 21 is, in turn, held immovably in position in the intermediate shaft. Consequently, these dome ribs 51 will spread out or extend gradually through the ascending of the upper ring 41 and the upward movement of the stretcher ribs 52 with the pivot joint of the intermediate ring 21 as the center. Simultaneously, following the upward movement of the stretcher ribs 52 by the supporting ribs 53 pivotably connected thereto and through the intermediary of lower ring 11, these stretcher ribs 52 in against the spring force of coil spring 7 will pull the outer shaft 1 upward with respect to the intermediate shaft 2. Following the ascending of this outer shaft 1, the coil spring 7 disposed between the intermediate and the lower rings 21, 11 is also compressed thereby storing elastic energy for use next in the closing of the umbrella. The coil spring 7 is now fully compressed and again the intermediate ring 21 remains un-moving, thereby permitting the ribs, 52 and 53, respectively of the intermediate and the lower rings 21, 11 to form into an un-moving rigid body, which even if the ribs 51 are under the upward pulling force of the upper ring 41, is unable to move upwardly. The coil spring 8 is, however, in a partially extended position now when there is still maintained some extension forces and therefore prevent the upper ring 41 from moving downwardly, while the same strength thus keeps the ribs 51, 52 and 53 to be an un-moving framework and which can hardly be downwardly pivotable. In this way, the umbrella is now opened completely in a fully extended state as shown in FIG. 2 to be ready for use.

When the umbrella which has been opened is next to be closed, the push button is depressed against the spring force of the springs 64, 97 so that the abutment surface 66 moves to a second stop position against the edges 231 of the opening 23 of the intermediate shaft 2. This is possible since the outer shaft 1 has been raised, thus vacating the area in front of the intermediate shaft. Thus, the surface 66 is able to travel beyond the first stop position and press the pawl head 92 out of the opening 23 of intermediate shaft 2. Although the coil spring 8 still has a tendency of urging the lower inner shaft 3 to move downward, that is, to push said lower inner shaft outward, nevertheless, since the grip 31 is firmly held in the user's hand, this lower inner shaft 3 will not move. The extension force of the coil spring 8 acts instead of the upper inner shaft 4 which is made to slide upward with relation to the intermediate shaft 2 and tends to bring the ribs 51 to be closed thereby. Meanwhile, as the intermediate shaft 2 is now in a freely slidable state, the coil spring 7 by its extension force and through the intermediary of the intermediate shaft 21 urges the intermediate shaft 2 to move upward and the outer shaft 1 downward. When the intermediate shaft 2 is ascending, the outer shaft 1 relative to said intermediate shaft 2 moves downwardly till the projection of intermediate shaft 2 has been engaged in the guide-channel check shoulder 321. Now, since both the outer and the intermediate shafts 1, 2 have the openings 12, 23 thereof being engaged to the locking head 96 and are thus not upwardly movable, the movement of these shafts 2, 1 causes the rib assembly 5 to be rotate down to a collapsed position. As a result, the ribs 51 are collapsed and folded together through the linked movement of the stretcher and the supporting ribs 52, 53 and the respective rings 11, 21 and 41 with both coil springs, 7 and 8 in their fully extended and substantially unstressed condition as shown in FIG. 3. As a next and final step of the series of operation, the shaft is contracted by holding the umbrella down against the ground or any hard surfaces and applying compression force at the opposite end of the shaft, i.e., at the upper inner shaft 4 and the grip 31, in opposing the extension force of the coil spring 8. As the compression force is being applied, the lower inner shaft 3 will be inserted deeply into the intermediate shaft and the coil spring 8 will also be compressed causing now the outer and the intermediate shaft 1, 2 to be engaged therein by the locking head 96 of spring pawl 95 when, both the shafts 2, 1 will be held together with the lower inner shaft 3 as a single body. By now, the compression force of the first coil spring 7 has weakened and is in a free and released state whereas the second coil spring 8 is in a compressed position, whereby energy to be consumed for opening or expanding the umbrella is stored.

As described above, in accordance with the present invention, there is provided an umbrella wherein expanding and closing operations are initiated by a single push button in a unidirectional manner. Again, owing to the two-stage type actuating construction in the umbrella, such conventional drawbacks, as pressing of a wrong push button, can be avoided since a user will not in any way perform an actuating action for closing the umbrella before it has been opened. Furthermore, because of the simple actuating control in a unidirectional fashion, the umbrella of the invention can be used with greater convenience. Since the construction of the single push button control according to the present invention is simplified and occupies less space on the umbrella grip, the manufacture and assembly work is easier and the cost of production is reduced. Also, a neat and esthetic design of the grip is made more possible.

The foregoing is a description of the preferred embodiment of the invention and it should be understood that changes and variations may be made thereto without departing from the true spirit of the invention as defined in the appended claims.

I claim:

1. An automatically actuated umbrella having a single push button to initiate expanding and collapsing operations, comprising:

outer shaft means including an outer tubular shaft and a lower ring fixedly attached to said outer tubular shaft, intermediate shaft means including an intermediate tubular shaft slidably telescoped within said outer tubular shaft and an intermediate ring affixed to said intermediate tubular shaft at a location above said outer tubular shaft, upper inner shaft means including an upper inner shaft slidably telescoped relative to an upper end of said intermediate tubular shaft and an upper ring affixed to said upper inner shaft at a location above said intermediate shaft means, a lower inner shaft slidably telescoped within a lower end of said intermediate tubular shaft, and a rib arrangement including dome ribs, stretcher ribs, and supporting ribs having inner ends thereof pivotably connected to said upper ring, intermediate ring, and said lower ring, respectively, with outer ends of said stretcher ribs and supporting ribs being pivotably connected to said dome ribs and stretcher ribs, respectively, to form an umbrella frame, said rib arrangement being movable between expanded and collapsed positions, first spring means arranged to act between said outer and intermediate shaft means for moving said rib arrangement to said collapsed position, second spring means arranged to act between said lower inner shaft and said upper inner shaft means for moving said rib arrangement to said expanded position, said outer tubular shaft, said intermediate tubular shaft, and said lower inner shaft including lateral openings which are laterally alignable, locking pawl means mounted for movement in said lower inner shaft, having a locking head, and being yieldably spring-biased laterally outwardly to a locking position wherein said locking head projects into all of said openings when said openings are laterally aligned, to retain said rib arrangement in a collapsed position with said second spring means being in an energy-storing state, a grip affixed to a lower end of said lower inner shaft and including a side wall disposed outside of said lower inner shaft, said grip including a push button mounted in said side wall and yieldably spring-biased laterally outwardly, said push button including an abutment surface opposing said locking head and said aligned openings, said push button being movable in a direction of actuation to displace said locking head inwardly and out of said opening of said outer tubular shaft in response to a first inward depression of said push button to a first stop position in engagement with said outer tubular shaft to enable said upper inner shaft means and said outer shaft means to be raised relative to said intermediate shaft means by said second spring means in a manner expanding said rib arrangement while causing said first spring means to store energy, with said locking head remaining within said opening of said intermediate tubular shaft and retaining said first spring means in such energy storing state, said push button being movable in said direction of actuation to displace said locking head inwardly and out of said opening of said intermediate tubular shaft in response to a second inward depression of said push botton to a second stop position beyond said first stop position vacated by said outer tubular shaft upon the raising of the latter, said second stop position defined by engagement of said push button with said intermediate tubular shaft to enable said second spring means to raise said upper inner shaft means relative to said outer shaft means and to enable said first spring means to raise said intermediate shaft means relative to said upper inner shaft means for collapsing said rib arrangement.

2. An umbrella according to claim 1, wherein said push button is linearly movable with respect to the direction of actuation when depressed.

3. An umbrella according to claim 1 including third spring means for biasing said pawl means laterally outwardly, and fourth spring means separate from said third spring means for biasing said push button laterally outwardly.

4. An umbrella according to claim 1, wherein said first stop position is defined by edges of said opening of said outer tubular shaft, and said second stop means is defined by edges of said intermediate tubular shaft.

5. An automatically actuated umbrella having a single push button to initiate expanding and collapsing operations, comprising:

a shaft assembly including a plurality of slidably telescoped shafts, a rib arrangement pivotably mounted to said shaft assembly such that said rib assembly is disposed in an expanded state when said shafts are in a first position relative to one another and disposed in a collapsed state when said shafts are in a second position relative to one another, spring means operably connected to said shaft assembly for biasing said shafts toward said first and second positions, said shaft assembly including:

an inner shaft carrying a manual grip, an intermediate shaft slidably telescoped on said inner shaft, and an outer shaft slidably telescoped on said intermediate shaft, said intermediate, and outer shafts including alignable lateral openings, and actuating means comprising:

locking pawl means mounted for movement in said inner shaft, having a locking head and being yieldably spring-biased laterally outwardly to a locking position wherein said locking head projects into said openings when said openings are laterally aligned, for resisting movement of said outer and intermediate shafts in order to retain said rib arrangement in a collapsed state, a push button mounted in said grip and yieldably spring-biased laterally outwardly, said push button including an abutment surface opposing said pawl and said outer shaft when said outer and intermediate shafts are retained by said locking head, said push button being movable in a direction of actuation to displace said pawl in a manner moving said locking head inwardly and out of said opening of said outer shaft in response to a first inward depression of said push button to a first stop position against said outer shaft to enable said shaft assembly to be moved to said first position by said spring means in a manner raising said outer shaft and expanding said rib arrangement, with said locking head remaining within said opening of said intermediate shaft, said push button being movable in said direction of actuation to displace said locking head inwardly and out of said opening of said intermediate shaft in response to a second inward depression of said push button to a second stop position beyond said first stop position vacated by said outer shaft upon the raising of the latter, said second stop position defined by engagement of said push button with said intermediate shaft to enable said shaft assembly to be moved to said second position by said spring means in a manner raising said intermediate shaft and collapsing said rib arrangement.

* * * * *